United States Patent [19]

Harrill

[11] 4,250,723

[45] Feb. 17, 1981

[54] APPARATUS FOR SEPARATING HOSIERY

[75] Inventor: John D. Harrill, Shelby, N.C.

[73] Assignee: Marvel Specialty Company, Inc., Hickory, N.C.

[21] Appl. No.: 17,600

[22] Filed: Mar. 5, 1979

[51] Int. Cl.[3] ..... D04B 15/88; D04B 15/92

[52] U.S. Cl. ..... 66/147; 66/149 S

[58] Field of Search ..... 66/147, 149 R, 149 S, 66/152, 153; 28/170

[56] References Cited

U.S. PATENT DOCUMENTS

| | | | |
|---|---|---|---|
| 1,103,922 | 7/1914 | Adamee | 66/147 X |
| 3,017,314 | 1/1962 | Kebekus et al. | 66/147 UX |
| 3,282,070 | 11/1966 | Perkins | 66/147 |
| 3,448,594 | 6/1969 | Macon | 66/147 |
| 3,756,044 | 9/1973 | Grizzle | 66/147 |
| 3,779,046 | 12/1973 | Perkins | 66/147 |
| 4,116,021 | 9/1978 | Harrill | 66/149 S |

FOREIGN PATENT DOCUMENTS

| | | | |
|---|---|---|---|
| 7018427 | 6/1972 | Netherlands | 66/147 |
| 7609474 | 2/1978 | Netherlands | 66/147 |

*Primary Examiner*—Wm. Carter Reynolds

*Attorney, Agent, or Firm*—Lowe, King, Price & Becker

[57] ABSTRACT

Apparatus is disclosed for separating hosiery produced on a circular knitting machine. The hosiery is knitted as a continuous tubular fabric with a weakened portion being formed between articles to be separated. The separating apparatus includes a frame mounted below the knitting machine, a gripping and separating arm pivotally mounted on the frame, and a fixed clamping arm mounted on the frame below the gripping and separating arm. The gripping arm and the clamping arm each include a pair of jaws which are intermittently actuated to engage the tubular fabric adjacent the weakened portion of the articles. The gripping arm is pivoted to exert an arcuate pulling force upwardly away from the clamping arm to cause the articles to be separated along their weakened portions. The separation action is arranged so as to prevent stretching of the fabric coming from the knitting machine. A fabric guide and a pneumatic transport for the separator are also disclosed.

17 Claims, 7 Drawing Figures

FROM KNITTING HEAD
1
17
19
21
23
25
27
29
31
33
35
37
38
39
41
43
45
47
49
51
53
55
57
59
77
S1
S2
W 1
17
23
25
29
33
35
37
39
41
55
59

APPARATUS FOR SEPARATING HOSIERY

BACKGROUND OF THE INVENTION

The invention relates to hosiery handling apparatus and, more particularly, to apparatus for successively separating articles formed in a continuous string on a circular knitting machine.

DESCRIPTION OF THE PRIOR ART

Hosiery for many years has been knitted as a string of continuous tubular fabric on Komet machines manufactured by Scott & Williams, Incorporated, New York, New York. These machines have become a standard in the industry for knitting a wide range of hosiery for men, women and children. The individual articles of hose are connected by a ring of alginate or PVA (polyvinylacetate) yarn which provides a break-away connection between the hose.

To further process the hosiery, a "knitter" must periodically remove the string of hose from the storage cannister on the machine. The "knitter" then separates the hose by tearing the alginate yarn ring. This operation presents the individual hose in an inverted condition. In some installations it is desirable to first turn the hose before separating. This can be done by hand, but it will be appreciated that manual separation and handling of hosiery is a wasteful and uneconomical process.

Various attempts over the years have been made to provide greater efficiency for handling the hose coming from the Komet knitting machine. The best "on machine" operation that has been accomplished prior to the present invention is disclosed in my U.S. Pat. No. 4,116,021, entitled Hosiery Handling Apparatus and Method. This machinery provides a combined inversion and separation process. Each in line hose is inverted into a vertically suspended tube and then jerked away from the string, thereby breaking the alginate ring.

There are prior art "on machine" operations that do not invert. U.S. Pat. No. 3,448,594 discloses an automatic separator for hosiery comprising a clamping member through which tubular fabric passes after being produced on a circular knitting machine, the clamping member intermittently clamping the tubular fabric at the same time pulling rollers disposed below the clamping member are actuated for exerting a mechanical pull on the tubular fabric to separate the same. U.S. Pat. No. 3,282,070 discloses apparatus for separating hosiery comprising a pair of gripping and pulling rollers and a clamp member disposed above the gripping and pulling rollers. The tubular fabric is continuously engaged by the gripping and pulling rollers; the clamping member intermittently engages the tubular fabric just above the weakened portion between each of the hosiery articles to cause the hosiery to be separated along the weakened portion. While these devices have worked to some degree, they have been generally unsuccessful in the knitting mills since the tension applied to the hosiery during separation oftentimes will be transferred up past the takedown rolls of the knitting machine to the needles of the machine. This results in deleterious distortion of the knitting pattern causing the hose to be rejected by mill quality control. Sometimes, this condition even causes misalignment, bending and breakage of the needles in the machine.

Also, in these prior art designs, if the upper clamp does not release quickly enough there is a problem of twisting of the hosiery by the rotation of the knitting head, since there is no slack between the knitting head and the upper clamp.

It would be a great benefit to the knitting industry if a machine were provided for "tensionless" separation of continuously knitted tubular hose. It is therefore a primary object of the present invention to provide a hosiery handling apparatus in which article separation is performed in a substantially "tensionless" manner.

It is another object of the present invention to provide a hosiery handling apparatus wherein a string of continuous tubular fabric from a Komet-type knitting machine is separated along an arcuate path.

It is a further object to provide a hosiery separation in which the lower clamp is fixed and the upper gripping arm is pivotally attached for causing a separation motion towards the knitting head.

It is yet a further object of the invention to provide a transporting apparatus for conveying the separated articles to a receptacle.

It is still another object of the invention to provide hosiery separation apparatus which may be easily attached to a Komet-type knitting machine wherein the machine may be easily converted without major modification to perform the separation operation, and without requiring additional floor space or in any way limiting access to the parts of the knitting machine for maintenance.

SUMMARY OF THE INVENTION

In accordance with my invention, a knitting machine, such as the above-described Komet machine, is fitted with a hosiery separation device comprising a frame mounted below said knitting machine, a gripping and separating arm pivotally mounted on the frame, and a clamping arm mounted on the frame downstream from the gripping and separating arm. The gripping and separating arm and the clamping arm each include a pair of jaws attached to the respective ends of each arm for releasably engaging the knitted tubular fabric as it comes from the knitting machine. The gripping jaws and the clamping jaws intermittently engage the tubular fabric adjacent the weakened portion of the articles, the gripping arm exerting an arcuate pulling force upstream away from the clamping arm to cause the articles to be separated along the weakened portions. The machine is further provided with actuators for opening and closing the gripping jaws, the clamping jaws, and for pivoting the gripping and separating arm. The actuators preferably comprise pneumatic cylinders.

The apparatus may further include conveying means comprising a funnel located downstream from the clamping arm, a hollow tube connected to the funnel, and means for applying suction pressure to the separated articles to convey the articles through the hollow tube to a receptacle or bin. The gripping and separating arm may also include a hollow cylindrical guide member mounted above the gripping jaws for guiding the tubular fabric into the gripping jaws.

Unlike prior art separation devices, in the present invention the separation or pulling forces are directed up stream toward the knitting machine to provide slack so as to put no tension on the take-down rollers and the knitting head during the separation process. The separation process of the present invention acts to prevent stretching of the fabric coming from the knitting machine during separation, reduces wear and tear on the take-down rollers by providing the desirable amount of slack between the gripping arm and the take-down rollers. This also prevents damage to the needles and substantially reduces twisting of the hosiery during separation.

In addition, the components of the present invention are arranged to provide an arcuate force upwardly between the lower stationary clamping arm and the upper pivoting, gripping and separating arm. The arcuate separating motion tends to cause the line of separation along the weakened portions of the articles to begin at one point, rather than throughout the entire weakened portion as would occur in machines of a straight-line separation type.

BRIEF DESCRIPTION OF THE DRAWING FIGURES

These and other objects, features and advantages of the invention are presented in the following detailed description of the preferred embodiment and illustrated in the accompanying drawings, wherein.

DESCRIPTION OF THE PREFERRED EMBODIMENT

Figure 1:
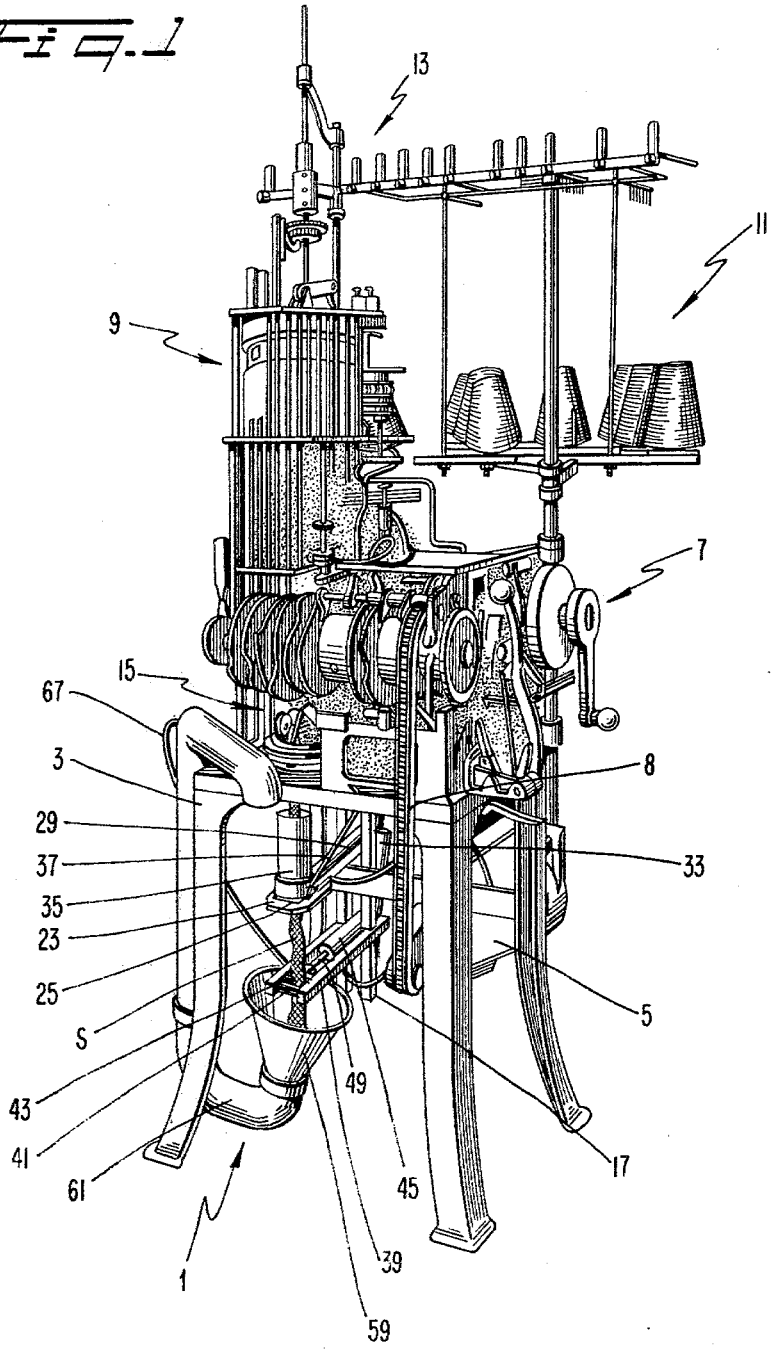
FIG. 1 is an overall perspective view of a Komet-type knitting machine with the hosiery separation attachment of the present invention mounted thereon.

A standard Komet-type knitting machine in FIG. 1 includes a hosiery separation mechanism 1, constructed in accordance with the principles of the present invention. This preferred embodiment is basically mounted beneath the base table 3 of the knitting machine. The knitting machine also includes a main drive motor 5, a cam drive sub-assembly, generally designated by the reference numeral 7, and main drum chain 8, a circular knitting head, generally designated by the reference numeral 9, and a yarn supporting section generally designated by the reference numeral 11. Above the knitting head 9 is a support tower 13 that in the standard machines serves to support and guide a star rod and star disc assembly to spread the heel and toe of the hosiery as it is being knitted. Take-down rollers 15 are positioned below the knitting head 9 in the standard machine. Rollers 15 serve to apply the proper tension to the yarn in the knitting head. While it will be obvious that the separation device covered by the preferred embodiment shown in FIG. 1 has characteristics that uniquely adapt it to the field of hosiery manufacture, the invention will also be recognized as having application to the manufacture of other knitted articles that may be knitted in a string connected by rings of alginate yarn on a circular knitting machine.

The hosiery handling mechanism 1 may be easily mounted directly on the knitting machine without major modification of the machine and without requiring significant additional floor space. Most of the mechanism is positioned below the base 3 of the Komet-type knitting machine. It should be recognized, however, that the particular location of the components of the apparatus on a knitting machine are not critical. The primary objective here is to have the component adjacent or on the frame of the machine and as closely as possible within the confines of the original machine. Thus, variations in location of the parts can also be made without departing from the principles of the present invention.

Figure 3:
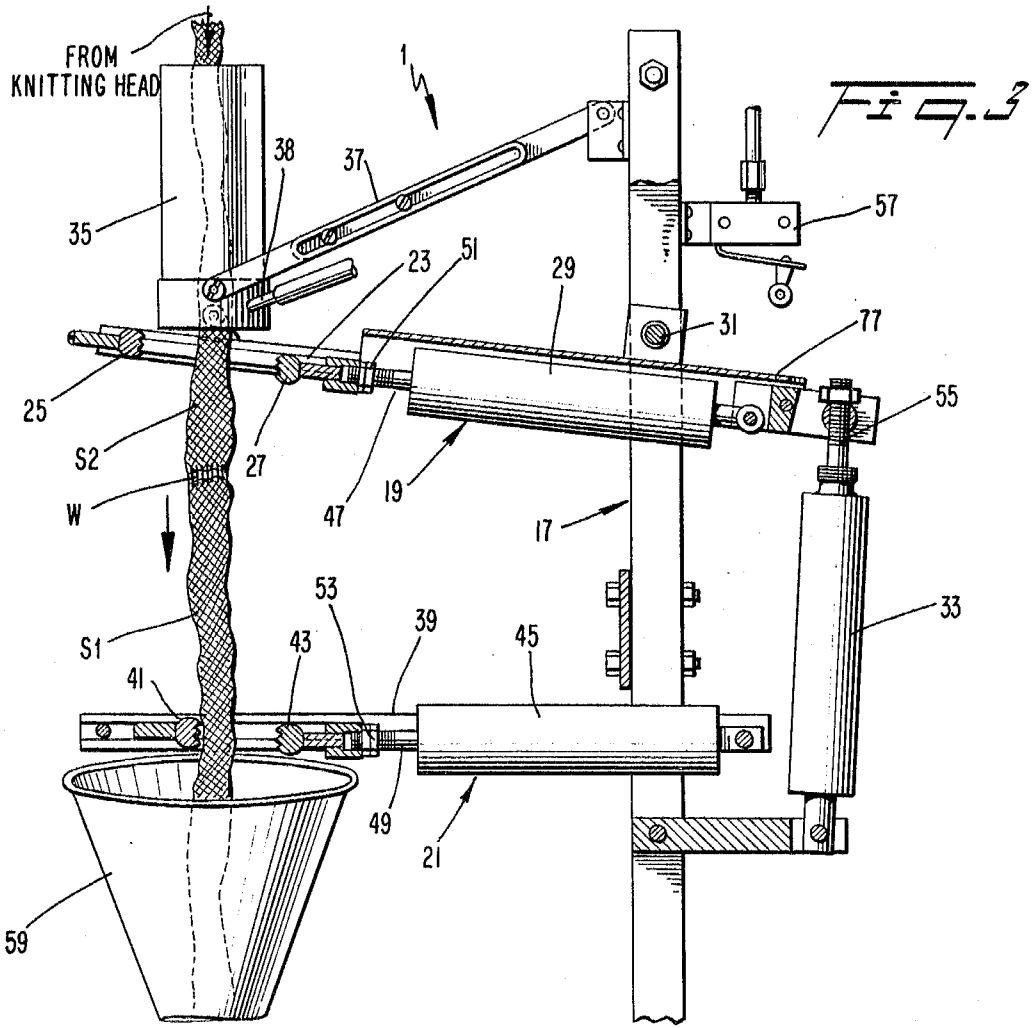
FIG. 3 is a side view of the hosiery separation apparatus as shown in FIG. 2.
Figure 2:
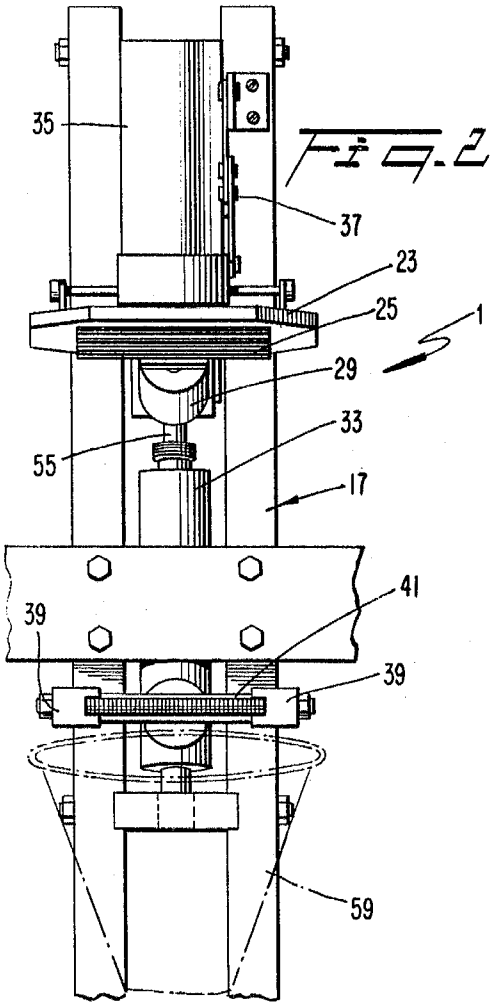
FIG. 2 is a front view of the hosiery separation apparatus of the present invention.

Referring now to FIGS. 2 and 3, there is shown, respectively, front and side views of the separating apparatus 1 of the present invention in its unactivated position. The apparatus comprises frame member 17 which is attached to the underside of the knitting machine table 3, a gripping and separating means, denoted generally at 19 pivotally mounted to the frame, and a clamping means, denoted generally at 21, mounted to the frame downstream of the gripping and separating means 19.

Gripping and separating means 19 comprises an arm 23, a pair of sliding jaws 25, 27 mounted on one end of arm 23, and an actuating means or cylinder 29 mounted on the arm 23 for intermittently closing jaws 25,27. Arm 23 is pivotally mounted to frame 17 by pivot member 31. Pivoting or cylinder means 33 is pivotally attached to the other end of arm 23 and to the frame member 17. Cylinder 33 may be intermittently actuated to cause arm 23 to pivot about member 31.

The gripping and separating means further includes a guide member 35 comprising a hollow cylindrical tube for guiding a string or stream of knitted articles S1, S2, etc., through the gripping jaws 25,27. Guide member 35 is pivotally attached to arm 23 directly above jaw members 25,27. Guide member 35 also includes a sliding linkage 37 attached at one end to member 35 and at the other end to frame 17. Linkage 37 acts to keep the center axis of guide member 35 substantially vertical throughout the arcuate path prescribed by arm 23 whenever it is pivoted. Air nozzle 38 on the base of the guide member 35 is directed at an angle downwardly and opposite the rotating action of the knitting head (CCW in FIGS. 3–5) to help retain the article S2 stretched downwardly within the tube and in an untwisted condition. This occurs as the jaws 25,27 reach the apex of travel (FIG. 5).

Clamping means 21 comprises an arm 39, a pair of sliding jaws 41, 43 mounted on one end of arm 39, and an actuating means or cylinder 45 mounted on arm 39 for intermittently closing jaws 41, 43. Arm 39 is fixedly attached to frame 17.

As can be seen, the clamping arm 39 is mounted downstream from the gripping and separating arm 23. Downstream, in this sense, means the position or direction away from the knitting head 9 of the knitting machine. Thus, it can be seen that gripping and separating arm 23 is pivotally mounted "upstream" (closer to the knitting head) above the fixed clamping arm 39. The pivot member 31 extends substantially perpendicular to the path of travel of the knitted articles $S_1$, $S_2$. Thus, as arm 23 pivots it will move along an arcuate path in upstream motion.

Also shown in FIG. 3 are the adjustment features for sliding jaws 25, 27 and 41,43. In the preferred embodiment, jaws 25 and 41 are fixed in position, while jaws 27, 43 are attached to actuator rods 47,49 which in turn are connected to cylinders 29 and 45, respectively. Rods 47,49 each have a threaded end and include adjusting means or lock nuts 51,53 disposed thereon. Rotation of the rods 47,49 locked by nuts 51,53 allow the "throw" of the actuators 29,45 to be adjusted along with the amount of jaw opening (see FIG. 7).

Actuator means 29 and 45 and pivoting means 33 each preferably comprise a pneumatically operated cylinder, though other types of actuators may be used. Cylinders 29, 45 and 33 are usually actuated by a source of compressed air (not shown). Actuator 33 also includes a threaded rod and lock nut adjustment feature 55, similar to that described above with respect to the gripping arm 23 and clamping arm 39 (see FIG. 3). Also shown is a pneumatic actuator switch 57 which serves to operate the air nozzle 67 creating suction into funnel 59 and along conveying tube 61. The top portion of the conveying funnel 59, located just downstream from the clamping jaws 41, 43 can be seen in FIG. 2. Funnel 59 acts to receive the articles S1, S2, etc., after separation is accomplished. As noted above, weakened portion W knit with alginate yarn is used to link hosiery articles S1, S2, etc., together in a continuous stream of tubular fabric.

Figure 7:
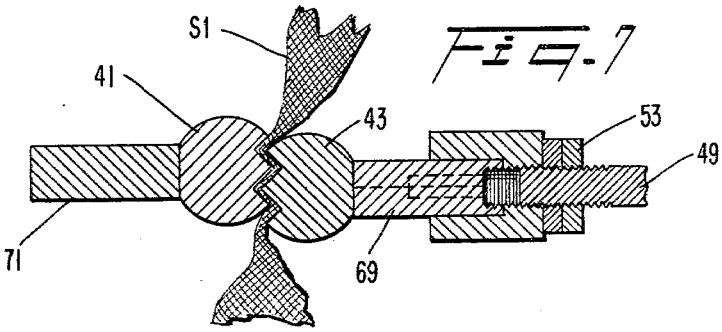
FIG. 7 shows a detail view of the gripping jaws and clamping jaws of the present invention.

The construction of the clamping jaws 41,43 are shown in more detail in FIG. 7. The construction of the gripping and separating jaws 25,27 is substantially identical. Jaws 41 and 43 each comprise an elongated bar having a series of mating grooves formed on the faces thereof. Fixed jaw 41 is attached to a flat bar 71 whose ends are fixed on the inside of the two parallel beams comprising clamping arm 39. Similarly, sliding jaw 43 is attached to bar 69 (see FIG. 7) which slidably rides in grooves on arm 39. Bar 69 is in turn attached to the adjustable end of an actuator rod 49. Of course, other arrangements and configurations could be chosen for the fixed and sliding bar assemblies.

Figure 4:
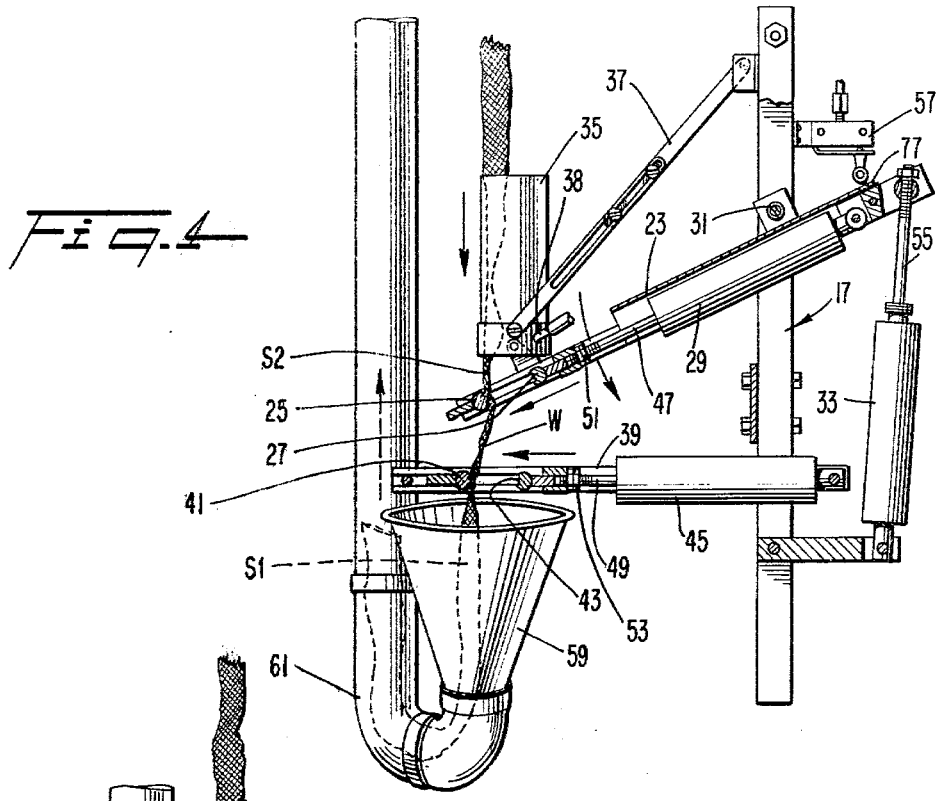
FIG. 4 shows the hosiery separation apparatus at the beginning of a separation cycle.
Figure 5:
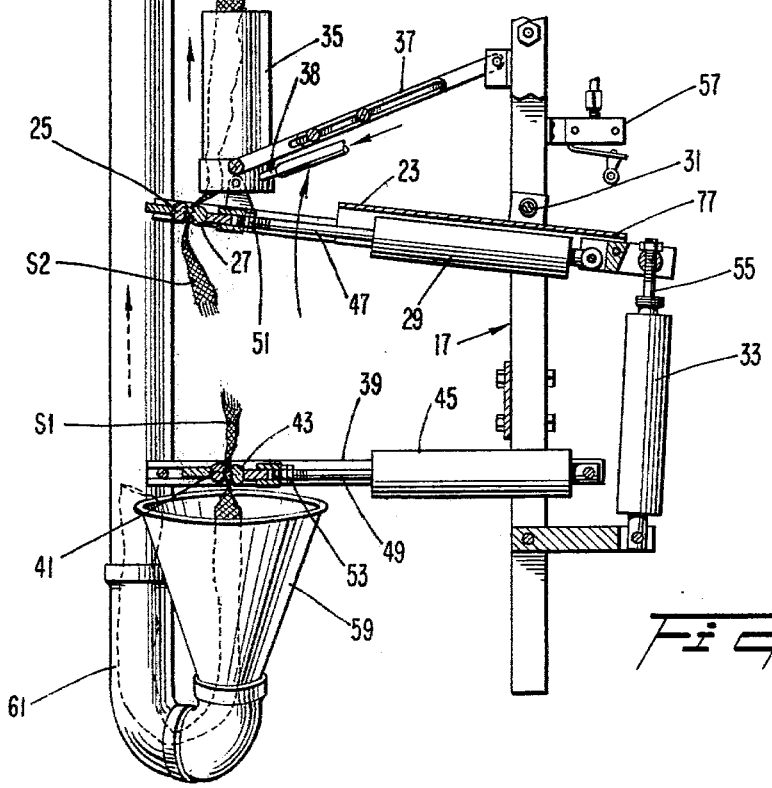
FIG. 5 shows the hosiery separation apparatus at the end of a separation cycle.

Referring now to FIGS. 4 and 5, there are shown two views of the present invention during a separation operation.

The operation of the inventive separator is preferably initiated and timed by a plurality of air valves and microswitches. For example, a kick link (not shown) forming a part of the main drum chain 8 can trip the circuit opening a poppet valve (not shown) to initiate the cycle.

Alternatively, a timing mechanism, similar to that shown and described in U.S. Pat. No. 4,116,021 and assigned to the assignee of this invention (not shown here), may be used to control the actuation of cylinders 29,45 and 33. The timing mechanism (not shown) may be of conventional design and includes a rotating timing drum having a plurality of raised cams on its surface and a pneumatic microvalve assembly operated by the cams. High pressure air is supplied to the valves which, when actuated by the timing drum, supply the air to cylinders 29, 45 and 33. The timing drum is rotated in a stepped fashion by a power link operated directly from the cam drive assembly 7. The timing drum is stepped in timed relationship with the knitting operation, thus eliminating the need for sensing the position of the hosiery string or Alginate ring. By suitable placement of the raised cams on the timing drum, cylinders 29,45 and 33 may be activated or deactivated in any desired sequence.

In FIG. 4, the jaws are starting to close in the home position. The gripping arm 23 is shown just before being pivoted upwardly by actuator 33 in response to a delayed valve in the timing mechanism (not shown). In other words, the jaws 25,27 are positioned fully downstream until said jaws 25,27 are adjacent the clamping jaws 41,43 and the timing mechanism next causes actuator 29 to close jaw members 25,27 of the gripping arm so as to engage the hosiery material adjacent to and slightly above the weakened portion W. Simultaneously with engagement of jaws 25,27, the timing mechanism causes actuator 45 to close jaws 41,43 of the clamping arm 39 so as to engage the hosiery material adjacent to and slightly below the weakened portion W. As soon as both sets of jaws are engaged, the timing mechanism causes the cylinder actuator 33 to be activated, moving the arm 23, as shown in FIG. 5.

Thus, the gripping and separating jaws 35, 37 carried by pivotally mounted arm 23 are moved rapidly upstream (toward the knitting head) along an arcuate path, the pull exerting a first force component parallel to the path of movement of said tubular fabric and a second force component perpendicular thereto. Since the tubular or hosiery fabric is tightly held by gripping jaws 25,27 and the clamping jaws 41, 43, the result is that a composite arcuate pulling force is exerted upwardly (upstream) on the weakened portion W between hosiery articles S1, S2 causing the two articles to be separated. More specifically, the composite arcuate pulling force is concentrated initially within a small area of the weakened portion W due to the arcuate separating action provided by arm 23. As the pulling action progresses, the separation is rapidly completed across the full width of the portion W.

The timing mechanism then causes actuators 29 and 45 to open jaws 25,27 of the gripping arm and 41,43 of the clamping arm, respectively, to be opened when the gripping arm attains its fully upstream position (FIG. 3). At this point the apparatus will resume its unactuated position, as shown in FIG. 4, and be ready for the next separation cycle.

Figure 6:
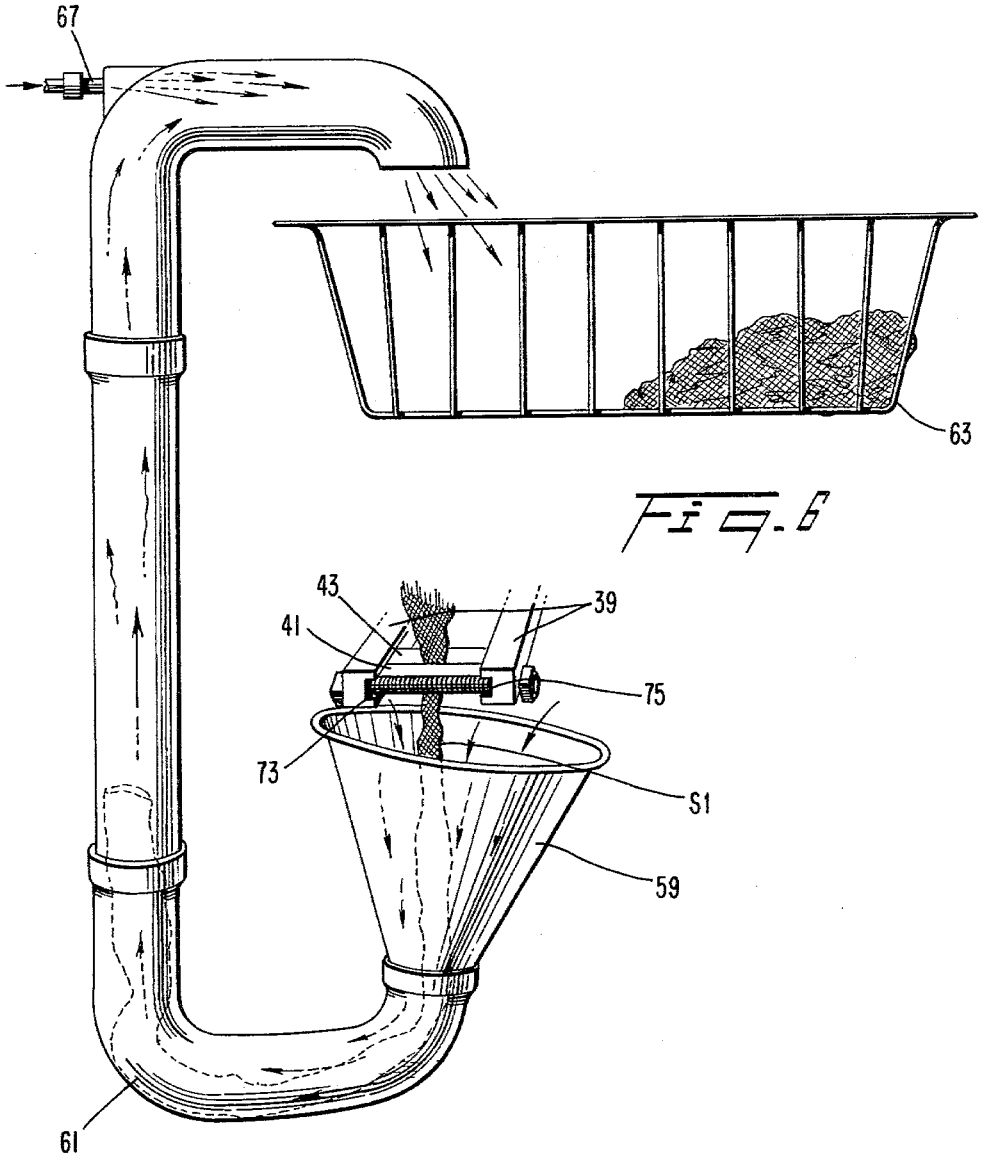
FIG. 6 shows a more detailed view of the pneumatic conveying apparatus used in conjunction with the present invention.

As shown in FIG. 6, upon separation, the hosiery article S1 will have its downstream end already disposed within funnel 59. Funnel 59 is attached to a hollow tube or conduit 61 with an outlet disposed over a receiving basket or receptacle 63. A source of air pressure is connected at at least one point in the conveying means at nozzle or inlet 67 disposed near the outlet of the tube 61. Air pressure applied at 67 acts to produce a negative pressure within funnel 59 by entrainment of the air within the tube 61. The initial leading or downstream portion of the article of hosiery is caught by the suction and the hosiery article is conveyed through the tube and into receptacle 63. Hosiery articles received in receptacle 63 may then be collected by the knitter or other operator as desired. The air switch 57 keeps the suction operating within the tube 61 until the arm 23 returns to the home position (see FIG. 4, switch 57 closed).

It will be appreciated that the described invention has several advantages over other types of hosiery separation apparatus. First, a relatively simple arrangement of components using common pneumatic cylinders and pneumatic control circuit may be employed. This results in increased reliability and economy of operation. Second, since the lower clamping jaws remain stationary during hosiery separation, while the gripping jaws are moved upwardly toward the knitting head, the hosiery coming off take-down rollers 15 is not under tension. This results in less chance for distortion in the knitted pattern and reduces wear and tear of the take-down rollers. Third, the separation action provided by pivoting arm 23 is along an arcuate path which causes the pulling forces within the weakened portion W to be concentrated within a small area rather than throughout the entire weakened portion as in prior art "straight-line" hosiery separation devices. This results in a smoother separating action at lower pulling forces, thus preventing tearing or distortion of the separated articles. Fourth, since there is no tension on the hosiery between the gripping means 19 and the take-down rollers 15 during separation, if the gripping jaws fail to open quickly enough the hosiery coming from take-down rollers 15 will not become twisted or entangled. In addition, the hosiery guide 35 acts to guide hosiery articles from the take-down rollers 15 into the area between the open jaws 25,27 of the gripping and separating means 19. Guide 35 aids in preventing twisting and tangling the next-in-line hosiery article during the separation process. Finally, the entire hosiery separation unit 1, including the conveying means 59, 61 and 67 can be readily mounted beneath or alongside the table 3 of a standard Komet-type knitting machine.

It can thus be seen that the present invention provides a simpler, more efficient and reliable hosiery separation apparatus than those previously known.

While the hosiery separation apparatus of the present invention has been described in considerable detail, it is understood that various changes and modifications may occur to persons of ordinary skill in the art without departing from the spirit and scope of the invention as it is defined in the appended claims.

What is claimed is:

1. An apparatus to successively separate articles from a fabric in tubular form having a weakened portion between the articles to be separated, the tubular fabric being continuously produced on a circular knitting machine with separation being accomplished as the tubular fabric passes downwardly therefrom, the combination comprising:

a frame mounted below said knitting machine;

an integral gripping and separating means pivotally mounted on said frame about an axis substantially perpendicular to the path of movement of said tubular fabric; and clamping means mounted on said frame downstream from said gripping and separating means;

means for actuating said gripping and separating means and said clamping means for intermittently engaging said tubular fabric adjacent said weakened portion of said articles, said gripping and separating means pivoting about said axis to move away from said clamping means while gripping said fabric to exert a composite arcuate pulling force upstream away from said clamping means including a first force component parallel to the path of movement of said tubular fabric and a second force component perpendicular thereto to cause said article to be separated along said weakened portion.

2. The separating apparatus of claim 1 wherein said means for actuating said gripping and separating means comprises:

an arm pivotally mounted to said frame;

gripping jaws attached to one end of said arm for releasably engaging said tubular fabric;

means connected to said gripping jaws for opening and closing said jaws; and means attached to said frame and to the other end of said arm for arcuately moving said arm in downstream and upstream motion to separate said articles along said weakened portion.

3. The apparatus of claim 1 wherein said means for actuating said clamping means comprises:

an arm attached to said frame;

a pair of clamping jaws attached to one end of said arm for releasably engaging said tubular fabric; and means connected to said clamping jaws for opening and closing said jaws.

4. The separating apparatus of claim 1 further including means for conveying said articles downstream after separation to a receptacle.

5. The apparatus of claim 4 wherein said conveying means comprises:

a funnel located downstream from said clamping means;

a hollow tube connected to said funnel; and means for applying air pressure to said separated articles to convey said articles through said hollow tube to said receptacle.

6. An apparatus to successively separate articles from a fabric in tubular form having a weakened portion between the articles to be separated, the tubular fabric being continuously produced on a circular knitting machine with separation being accomplished as the tubular fabric passes downwardly therefrom, the combination comprising:

a frame mounted below said knitting machine;

an integral gripping and separating means mounted on said frame about an axis substantially perpendicular to the path of movement of said tubular fabric, said gripping and separating means comprising:

an arm pivotally mounted to said frame;

gripping jaws attached to one end of said arm for releasably engaging said tubular fabric;

actuating means connected to said gripping jaws for opening and closing said jaws;

pivoting means attached to said frame and to the other end of said arm for arcuately moving said arm in downstream and upstream motion; and clamping means mounted on said downstream from said gripping and separating means;

said gripping and separating means and said clamping means intermittently engaging said tubular fabric adjacent said weakened portion of said articles, said gripping and separating means pivoting about said axis and moving relative to said clamping means to exert a composite arcuate pulling force upstream away from said clamping means including a first force component parallel to the path of movement of said tubular fabric and a second force component perpendicular thereto to cause said articles to be separated along said weakened portion.

7. The apparatus of claim 6 wherein said clamping means comprises:

an arm attached to said frame;

a pair of clamping jaws attached to one end of said arm for releasably engaging said tubular fabric; and actuating means connected to said clamping jaws for opening and closing said jaws.

8. The apparatus of claim 6 wherein said gripping jaws actuating means comprises a pneumatic cylinder.

9. The apparatus of claim 6 wherein said pivoting means comprises a pneumatic cylinder.

10. The apparatus of claim 7 wherein said clamping jaws actuating means comprises a pneumatic cylinder.

11. The apparatus of claim 6 further including means for conveying said articles after separation to a receptacle.

12. The apparatus of claim 11 wherein said conveying means comprises:

a funnel located downstream from said clamping means;

a hollow tube connected to said funnel; and means for applying air pressure to said separated articles to convey said articles through said hollow tube to said receptacle.

13. An apparatus to successively separate articles from a fabric in tubular form having a weakened portion between the articles to be separated, the tubular fabric being continuously produced on a circular knitting machine with separation being accomplished as the tubular fabric passes downwardly therefrom, the combination comprising:

a frame mounted below said knitting machine;

an integral gripping and separating arm pivotally mounted to said frame about an axis substantially perdendicular to the path of movement of said tubular fabric;

a pair of gripping jaws attached to one end of said gripping arm for releasably engaging said tubular fabric;

a first actuator connected to said gripping jaws for opening and closing said jaws;

pivoting means attached to said frame and to the other end of said gripping arm for arcuately moving said arm in a direction toward and away from said knitting machine;

a clamping arm attached to said frame below said gripping arm;

a pair of clamping jaws attached to one end of said clamping arm for releasably engaging said tubular fabric;

a second actuator connected to said clamping jaws for opening and closing said jaws;

said gripping jaws and said clamping jaws being intermittently closed by means of said first and second actuators to engage said tubular fabric adjacent said weakened portion of said articles, said gripping and separating arm being pivoted by said pivoting means for pivoting about said axis and moving relative to said clamping means toward said knitting machine to exert a composite arcuate pulling force away from said clamping arm including a first force component parallel to the path of movement of said tubular fabric and a second force component perpendicular thereto to cause said articles to be separated along said weakened portion.

14. The apparatus of claim 13 further including a hollow cylindrical guide member mounted on said gripping and separating arm above said gripping jaws for guiding said tubular fabric into said gripping jaws.

15. The separating apparatus of claim 14 wherein is provided an air nozzle within said guide member adapted to direct an air stream against said article downstream and opposite the twisting action of said knitting head.

16. The separating apparatus of claim 13 further including means for conveying said articles after separation to a receptacle.

17. The apparatus of claim 16 wherein said conveying means comprises:

a funnel located below said clamping jaws;

a hollow tube connected to said funnel; and means for applying air pressure to said separated articles to convey said articles through said hollow tube to said receptacle.

* * * * *